US006800600B1

(12) United States Patent
Strothoff et al.

(10) Patent No.: US 6,800,600 B1
(45) Date of Patent: Oct. 5, 2004

(54) CLEANING AGENT CONTAINING ALCOHOLATE

(75) Inventors: Werner Strothoff, Niederkrueschken (DE); Dieter Hemm, Hilden (DE); Guenter Hellmann, Hilden (DE)

(73) Assignee: Ecolab GmbH & Co. oHG, Düsseldorf (DE)

( * ) Notice: Subject to any disclaimer, the term of this patent is extended or adjusted under 35 U.S.C. 154(b) by 0 days.

(21) Appl. No.: 09/509,123

(22) Filed: Jul. 7, 2000

Related U.S. Application Data

(63) Continuation of application No. PCT/EP98/05811, filed on Sep. 12, 1998.

(30) Foreign Application Priority Data

Sep. 23, 1997 (DE) ..... 197 41 874

(51) Int. Cl.[7] ..... C11D 7/06; C11D 7/50; C11D 11/00; C11D 17/00

(52) U.S. Cl. ..... 510/404; 510/221; 510/225; 510/336; 510/435; 134/25.2; 8/137

(58) Field of Search ..... 510/221, 225, 510/336, 404, 435; 134/25.2; 8/137

(56) References Cited

U.S. PATENT DOCUMENTS

| | | | | |
|---|---|---|---|---|
| 3,607,764 A | | 9/1971 | Homer | 252/139 |
| 3,637,509 A | | 1/1972 | Brennan et al. | 252/99 |
| 4,343,739 A | | 8/1982 | Kakimi et al. | 424/1 |
| 4,590,237 A | | 5/1986 | Wuhrmann et al. | 524/480 |
| 4,753,755 A | | 6/1988 | Gansser | 252/527 |
| 4,801,396 A | | 1/1989 | Altenschoepfer et al. | 252/99 |
| 4,816,821 A | | 3/1989 | Loesel | 323/284 |
| 5,958,862 A | * | 9/1999 | Hemm et al. | 510/404 |
| 6,180,578 B1 | * | 1/2001 | Hemm et al. | 510/225 |

FOREIGN PATENT DOCUMENTS

| | | | |
|---|---|---|---|
| DE | 30 00 483 | | 7/1980 |
| DE | 31 38 425 | | 4/1983 |
| DE | 34 00 008 | | 7/1985 |
| DE | 36 33 518 | | 4/1988 |
| DE | 41 17 032 | | 11/1992 |
| DE | 42 28 786 | | 3/1994 |
| DE | 43 23 410 | | 1/1995 |
| DE | WO95/04124 | | 2/1995 |
| DE | 195 19 176 A1 | | 11/1996 |
| DE | 196 20 249 | | 11/1997 |
| EP | WO 96/27653 | * | 9/1996 |
| JP | 84/182870 | | 10/1984 |
| JP | 86/296098 | | 12/1986 |
| WO | WO 88/05814 | | 8/1988 |
| WO | WO 93/23522 | | 11/1993 |
| WO | WO95/04123 | | 2/1995 |
| WO | WO96/27653 | | 9/1996 |
| WO | WO97/412023 | | 11/1997 |
| WO | WO98/13466 | | 4/1998 |

OTHER PUBLICATIONS

Questel Patent Abstract (WPAT) No. 1996–425415 [42] Sep. 12, 1996.
Questel Patent Abstract (WPAT) No. 1998–230682 [20] Apr. 2, 1998.
Questel Patent Abstract (WPAT) No. 1997–551023 [51] Nov. 6, 1997.
Questel Patent Abstract (WPAT) No. 1983–24877K [15] Apr. 14, 1983.
Questel Patent Abstract (WPAT) No. 1994–075443 [10] Mar. 3, 1994.
Questel Patent Abstract (WPAT) No. 1985–172443 [29] Jul. 11, 1985.
Questel Patent Abstract (WPAT) No. 1988–093247 [14] Apr. 14, 1988.
Questel Patent Abstract (WPAT) No. 1980–51980C [30] Jul. 17, 1980.
Questel Patent Abstract (WPAT) No. 1992–399896 [49] Nov. 26, 1992.
Questel Patent Abstract (WPAT) No. 1995–052881 [08] Jan. 19, 1995.
Questel Patent Abstract (WPAT) No. 1995–082214 [11] Feb. 9, 1995.
Questel Patent Abstract (WPAT) No. 1997–480198 [44] Nov. 27, 1997.
107:42143g Solid Cleaning Compositions. *Surface–Active Agents*, vol. 107, pp. 129. 1987–No month given.

* cited by examiner

*Primary Examiner*—Yogendra N. Gupta
*Assistant Examiner*—Brian P. Mruk
(74) *Attorney, Agent, or Firm*—Merchant & Gould P.C.

(57) ABSTRACT

A paste-form to solid detergent composition is provided consisting of a) 21 to 70 percent by weight of an aqueous lye solution having a concentration of 42 to 55 percent by weight of lye; b) 0.5 to 40 percent by weight of one or more alcoholates of ethanol, propanol, isopropanol, glycerol or butyleneglycol, and c) 10 to 35 percent by weight of water. The detergent is a high alkaline detergent, useful for cleaning hard surfaces.

33 Claims, No Drawings

CLEANING AGENT CONTAINING ALCOHOLATE

This application is filed under 35 U.S.C. 371 and based on PCT/EP98/05811, filed Sep. 12, 1998.

BACKGROUND OF THE INVENTION

1. Field of the Invention

This invention relates to water-containing detergents based on alkali metal hydroxide with a paste-form to solid consistency. To adjust the consistency desired, the detergents contain alcoholates. The hardness and hardening time of the detergent may optionally be controlled by adding other components in a specific sequence.

2. Discussion of Related Art

Highly alkaline detergents are now commercially available in various forms, for example as powders, granules, liquids, fused blocks or tablets.

Each of these various forms has specific advantages and disadvantages for a given application. Powders, granules and liquids have been successfully used for cleaning textile surfaces or for the manual mechanical cleaning of hard surfaces while tablets or block-form detergents (fused blocks) obtained by melting and subsequent cooling are being increasingly used in addition to powders, granules or liquids for the machine cleaning of hard surfaces, for example for machine dishwashing. Tablets and fused blocks have the advantage over powders of simple, precise "dosing", no dust emission and easy handling.

These advantages may be utilized, for example, in domestic dish-washers, but above all in continuous institutional dishwashing machines in which the tableware to be cleaned pass through various washing zones.

It has now been found that very hard tablets and very hard fused blocks have disadvantages. For example, very hard tablets can be damaged by breakage. Tablets damaged in this way naturally no longer have the advantage of precise dosing. Another problem with tablets is that the required solubility in water cannot always be guaranteed, i.e. tablets occasionally dissolve either too quickly or too slowly. Although fused blocks show high fracture resistance in transit, these very hard detergents are problematical to dose from relatively large containers. In addition, both tablets and fused blocks have hitherto required elaborate production processes which, in view of the alkaline melts involved, impose particularly stringent demands on the materials used and the conditions selected.

The detergents obtained are also expected to show a high degree of homogeneity. With solid detergents, however, this often difficult to achieve. This problem does not affect liquid detergents, which can easily be stirred, as much as it does solid detergents. Accordingly, it would be desirable to have the homogeneity of a liquid, a viscous liquid or a stirrable paste which subsequently hardens into a solid of controllable, variable hardeness in order at this stage to utilize its advantages in regard to storage, transportation and dosing. It would be particularly desirable if stirrability could be maintained at temperatures of up to about 40° C., because even temperature-sensitive components could then be added. From the applicational point of view, it would be of particular advantage to prevent premature hardening of the material in the equipment used during the production process. Effective control of the parameters which critically influence the hardening process would be most particularly desirable.

The problem addressed by the present invention was to provide highly alkaline general-purpose detergents based on alkali metal hydroxide, preferably sodium or potassium hydroxide, more preferably sodium hydroxide, for textile surfaces, but preferably for cleaning hard surfaces, for example tableware, and in particular detergents for institutional dishwashing machines which would combine the advantages of powders and liquids on the one hand and the advantages of tablets and fused blocks on the other hand. In other words, the problem addressed by the present invention was to provide detergents which would show defined solubility under various in-use conditions, but which on the other hand would be stable in transit and in storage and, in addition, could be dosed quickly, simply and with precision, would not emit any dust and could be produced in a technically simple manner and which would be easy to package. In particular, stirrability during production, a consistency variable under control and delayed hardening in the production of solid detergents would afford major advantages and would be taken into account. At the same time, the invention set out to provide a process which would enable temperature-sensitive substances to be incorporated, if necessary even below 42° C., without in any way impacting on the other problems addressed by the invention. Like any industrial process, the process according to the invention would also seek to obtain a given effect at a favorable cost in regard to raw materials and production conditions.

The requirements which detergents are expected to meet, such as good cleaning performance, fat dissolving power, etc., would of course also have to be satisfied at the same time.

Both viscous or paste-like detergents and solid detergents in tablet or block form are already known from the prior art.

For example, according to DE-OS 31 38 425, the Theological behavior of the detergents disclosed therein is such that a gel-like paste can be liquefied by application of mechanical forces, for example by shaking or by application of pressure, to a deformable storage bottle or tube or by means of a metering/dosing pump and readily expressed from a spray nozzle.

U.S. Pat. No. 3,607,764 describes solid glass cleaning compositions which can be diluted to form a sprayable solution. These compositions contain inter alia sodium or potassium hydroxide, sodium or potassium tripolyphosphate, sodium or potassium pyrophosphate, hydroxycarboxylic acid builder, a water-soluble nonionic surfactant, alkylene glycol ether and optionally sodium carbonate. The control of viscosity or hardness as proposed by the present invention is not mentioned.

JA 84/182870 describes solutions of alkali metal hydroxides in glycols or alcohols which become viscosous through neutralization with long-chain carboxylic acids and which assume a paste-like consistency through the addition of silicone oil, so that they may be used as pastes for oiling leather.

JA 86/296098 describes water-free solid detergents based on alkali metal hydroxides. In this case, the alkali carrier is mixed with alkanolamines and water-soluble glycol ethers so that a solid detergent is obtained. The Japanese patent in question does not give any technical teaching on the variable reduction of hardness or on the control of the hardening process.

DESCRIPTION OF THE INVENTION

The present invention relates to a water-containing alkaline detergent containing a) aqueous lye, preferably potash or soda lye, preferably with a concentration of 42–55%, in a quantity of 21 to 70% by weight and preferably 35 to 55% by weight, based on the detergent and, to build up a high viscosity, b) one or more alcoholates corresponding to formula (I):

$$(R^1)(R^2)(R^3)C\text{-}O^-M^+ \quad (I)$$

in which $R^1$ and $R^2$ independently of one another represent a hydrogen atom or a linear or branched, saturated or unsaturated, substituted or unsubstituted $C_{1-3}$ alkyl group or a $—(CH_2)_n—CH_2—OH$ group with n=0 to 5 and the substituents $R^3$ independently of one another represent a hydrogen atom, a linear or branched, saturated or unsaturated, substituted or unsubstituted $C_{1-18}$ alkyl group, with the proviso that, when $R^1$ is the group $CH_2OH$ and $R^2$ is hydrogen, $R^3$ is not hydrogen or methyl, and $M^+$ is an alkali metal cation, preferably a sodium or potassium cation, in a total quantity of 0.5 to 40% by weight, preferably 1 to 10% by weight and more preferably 2 to 8% by weight (all percentages by weight are based on the detergent as a whole), and c) optionally alcohols corresponding to formula I and/or foam inhibitors and/or builder components and/or paraffin oil and/or surfactants and/or alkali metal hydroxide in solid form and/or other typical ingredients of detergents.

In their ready-to-use state, the detergents according to the invention have a paste-like or solid consistency, the transitions being fluid. They are preferably not pumpable at room temperature. However, the consistency according to the invention can also be manifested, for example, in the form of resistance to cutting. Many of the detergents according to the invention are still pourable during processing and can still be shaped by compression even after prolonged storage.

The detergents can undergo post-hardening in storage. This hardening process can take place very quickly, particularly where fine-particle alkali metal hydroxide is added. It is particularly favorable in this regard to use up to 35% by weight, preferably 2 to 25% by weight and more preferably 5 to 15% by weight of solid alkali metal hydroxide, based on the detergent as a whole. On the other hand, the hardening process can be slowed down by addition of surfactants, paraffin oil and polyhydroxy compounds.

The delayable hardening time is measured by continuing stirring after all the components have been added and observing it until it comes to a stop through hardening. At the point in time which is known as hardening and which can be controlled, the composition—purely phenomenologically—has a consistency in which it is unable, as required, to flow out through an outflow tube located in the bottom of a production vessel or from an inverted glass beaker.

The present invention also relates to a process for the production of these detergents. In the most simple case, they are obtained by stirring the alcoholates corresponding to formula I or the corresponding alcohols into the lye. Particularly preferred detergents are obtained if, thereafter, foam inhibitors and/or builder components, then surfactants and/or paraffin oil and, finally, 0.1 to 35% by weight and preferably 2 to 25% by weight, based on the detergent as a whole, of solid alkali metal hydroxide, preferably potassium or sodium hydroxide and, more preferably, sodium hydroxide are optionally added.

The present invention also relates to the use of the detergents for the machine cleaning of tableware and surfaces and for washing laundry.

In the most simple case, no other additives apart from the alcoholate as thickener and the lye are needed to obtain the required hardening effect according to the invention in aqueous soda lye providing the composition is selected in accordance with the invention. Through the preferred further addition of suitable quantities of paraffin oil, surfactants and solid alkali metal hydroxide, the consistency can be kept in a readily stirrable state at a reasonable temperature over an applicationally favorable period, in other words a controllable delay in hardening can be achieved.

Finally, the water content is another critical parameter and is between 10 and 35% by weight and advantageously between 20 and 30% by weight.

In view of the high NaOH content, the pH value of the detergents according to the invention is above 13.

In addition to the ingredients already mentioned, the detergents according to the invention may contain other ingredients typical of alkaline detergents providing the variable hardness according to the invention is not lost as a result. Accordingly, the detergent of lye, preferably potash and soda lye, more preferably soda lye, substance I or the corresponding alcohol and optionally solid alkali metal hydroxide, preferably sodium hydroxide, and also surfactants and/or paraffin oil acts as a carrier phase for other ingredients typically encountered in detergents.

The compounds corresponding to formula I are alcoholates of commercially available alcohols except for the alcoholates of ethylene glycol and 1,2-propylene glycol. Different properties are obtained with increasing alkyl chain length. Thus, the thickening effect of the alcoholates seems to diminish gradually with increasing chain length. Branches in the alkyl chain also appear to affect the thickening process. Alcoholates of methanol, ethanol, propanol, isopropanol, glycerol and butyleneglycol are preferably used as the compound of formula I. The alcoholates may readily be produced by the standard methods of organic chemistry. The alcoholates may also be produced in situ by adding the corresponding alcohols dropwise to the alkali metal hydroxide solution. Depending on the position of the equilibrium, a certain quantity of the alcohol corresponding to the alcoholate remains as such in the solution.

The quantity of alcoholate added should be between about 0.5 and about 40% by weight and is preferably from about 1 to about 10% by weight, based on the detergent as a whole. Since the alcoholate is in equilibrium with the corresponding alcohol, allowance should be made for any free alcohol present when calculating the quantity of alcoholate—as monoalcoholate in the case of polyhydric alcohols.

Suitable surfactants are both anionic surfactants and cationic surfactants, amphoteric surfactants and nonionic surfactants. Cleaning performance is critically influenced by the quantity of surfactants. The hardening time after all components have been added is particularly dependent on their concentration. Depending on the particular application, low-foaming surfactants, above all nonionic surfactants, may be used in a quantity of up to 10% by weight, preferably in a quantity of 0.1 to 5% by weight and more preferably in a quantity of 0.5 to 4% by weight, for example in the cleaning of tableware and surfaces. Extremely low-foaming compounds are normally used for machine dishwashing. These compounds preferably include $C_{12-18}$ alkyl polyethylene glycol polypropylene glycol ethers containing up to 8 moles ethylene oxide units and 8 moles propylene oxide units in the molecule. However, other known low-foaming surfactants, for example $C_{12-18}$ alkyl polyethylene glycol polybutylene glycol ethers containing up to 8 moles ethylene oxide units and up to 8 moles butylene oxide units in the molecule and end-capped alkyl polyalkylene glycol mixed ethers, may also be used.

If the mixtures according to the present invention are to be used for the machine washing of laundry, a relatively high surfactant content is recommended—generally up to 30% by weight, preferably from 0.1 to 15, more preferably from 1 to 10 and most preferably from 2 to 4% by weight, based on the detergent as a whole. In that case, anionic surfactants in particular, preferably from the group of alkyl benzenesulfonates, fatty alcohol sulfates and fatty alcohol ether sulfates, are used in addition to or instead of nonionic, cationic and amphoteric surfactants.

In the context of the invention, paraffin oil—of which up to 10% by weight may be present in accordance with the invention—is understood to be a long-chain branched or unbranched hydrocarbon. In one preferred embodiment, it is added to the detergents according to the invention in a quantity of 0.1 to 8% by weight and, more preferably, in a quantity of 0.5 to 5% by weight.

The detergents may optionally contain builders in a quantity of up to 60% by weight and preferably in a quantity of 15 to 40% by weight.

In principle, the builder present in the detergents according to the invention may be any substance known from the prior art as a builder suitable in the broadest sense for laundry and dishwashing detergents. Water-soluble builders are preferably used, although they may even be present in undissolved form in the detergents according to the invention. The coated builders known from the prior art may also be used and are even preferred in cases where chlorine-containing bleaching agents are used.

Suitable builders are, for example, alkali metal phosphates which may be present in the form of their sodium or potassium salts. Examples include tetrasodium diphosphate, pentasodium triphosphate, so-called sodium hexametaphosphate and the corresponding potassium salts or mixtures of sodium hexametaphosphate and the corresponding potassium salts or mixtures of sodium and potassium salts.

Complexing agents, for example nitrilotriacetate or ethylenediamine tetraacetate, may also be used. Soda and borax are also builders in the context of the present invention.

Other possible water-soluble builder components are, for example, organic polymers or native or synthetic origin, above all polycarboxylates. Suitable builder components of this type are, for example, polyacrylic acids and copolymers of maleic anhydride and acrylic acid and the sodium salts of these polymer acids. Commercially available products are, for example, Sokalan® CP 5 and PA 30 (BASF), Alcosperse® 175 and 177 (Alco), LMW® 45 N and SP02 ND (Norsohaas). Suitable native polymers include, for example, oxidized starch (for example DE 42 28 786) and polyamino acids, such as polyglutamic acid or polyaspartic acid, for example as manufactured by Cygnus, Bayer AG, Rohm & Haas, Rhone-Poulenc or SRCHEM.

Other possible builder components are naturally occurring hydroxycarboxylic acids such as, for example, monohydroxy and dihydroxysuccinic acid, α-hydroxypropionic acid, citric acid, gluconic acid and salts thereof. Citrates are preferably used in the form of trisodium citrate dihydrate.

Amorphous metasilicates or layer silicates may also be used as builders. Crystalline layer silicates are also suitable builders providing they are sufficiently alkali-stable. Crystalline layer silicates are marketed, for example, by Hoechst AG (Germany) under the trade name Na-SKS, for example Na-SKS-1 ($Na_2Si_{22}O_{45}.xH_2O$, kenyaite) Na-SKS-2 ($Na_2Si_{14}O_{29}.xH_2O$, magadiite), Na-SKS-3 ($Na_2Si_8O_{17}.xH_2O$), a-SKS4 ($Na_2Si_4O_9.xH_2O$, makatite), Na-SKS-5 (α-$Na_2Si_2Os$), Na-SKS-7 (β-$Na_2Si_2O_5$ natrosilite), Na-SKS-11 (τ-$Na_2Si_2O_5$) and NaSKS-6 (δ-$Na_2Si_2O_5$).

Particularly preferred builders are selected from the group consisting of pentasodium triphosphate, trisodium citrate, nitrilotriacetate, ethylenediamine tetraacetate, sodium salts of polyacrylic acid and of maleic acid/acrylic acid copolymers, soda, alkali metal silicate and mixtures thereof.

Bleaching agents typically used in detergents may also be present in the detergents according to the invention, preferably in quantities of 0.5 to 10% by weight and more preferably in quantities of 1.5 to 10% by weight. They may be selected from the group of oxygen-based bleaching agents, for example sodium perborate as such or even in the form of its hydrates or sodium percarbonate, or from the group of chlorine-based bleaching agents, such as N-chloro-p-toluene sulfonic acid amide, trichloroiso-cyanuric acid, alkali metal dichloroisocyanurate, alkali metal hypochlorites and agents which release alkali metal hypochlorites, alkali-stable bleaching compositions being particularly preferred. Such compositions may be both alkali-stable substances or components stabilized by suitable processes, for example by surface coating or passivation.

Other possible ingredients of the detergents according to the invention are defoamers. They may be used in concentrations of 0.1 to 5% by weight and preferably in concentrations of 0.5 to 3% by weight where a selected surfactant foams excessively under the prevailing conditions and have a foam-suppressing effect on foaming food residues in the dishwashing machine. Defoamers are understood to be any of the foam-suppressing substances known from the prior art, but especially those based on silicone and paraffin, above all the paraffin-based foam inhibitors described, for example, in DE 34 00 008, DE 36 33 518, DE 30 00 483, DE 41 17 032, DE 43 23 410, WO 95/04124 and hitherto unpublished German patent application 196 20 249. However, other defoamers may also be used.

Other ingredients optionally present are, for example, dyes or alkali stable perfumes. Although abrasive ingredients may be present in principle, the detergents according to the invention are preferably free from such ingredients.

Although thickeners, for example swellable layer silicates of the montmorillonite type, bentonite, kaolin, talcum or carboxymethyl cellulose, may optionally be used to vary the firmness of the detergents, they are not necessary for achieving the required controllable solid properties and the consistency of the detergents according to the invention, in other words thickeners need not be used.

The use of high-melting paraffins or high-melting polyethylene glycols for hardening mixtures is also not necessary for achieving the outcome according to the invention, but is not ruled out either. Nor is the use of long-chain fatty acids and long-chain fatty acid salts as used in the soap industry (chain lengths between $C_{12}$ and $C_{18}$) necessary for achieving the hardness according to the invention. In general, however, such substances are not detrimental to the result achieved in accordance with the invention. The production of liquid crystalline structures for thickening is not necessary either.

The present invention is also concerned with the hardening effect of the compounds corresponding to formula I in combination with solid alkali metal hydroxide, preferably potassium or sodium hydroxide, more preferably sodium hydroxide, with respect to lye, preferably potash and soda lye, more preferably soda lye, with the following delay in hardening by the addition of surfactants and/or paraffin oils.

Thus, the present invention relates to the use of compounds corresponding to formula I as a hardening agent for water-containing machine dishwashing detergents or laundry detergents containing alkali metal hydroxide, preferably sodium hydroxide, with subsequent addition of various components in a specific sequence, more particularly paraffin oil and/or surfactants, in combination with the subsequent addition of solid NaOH.

The present invention also relates to a process for hardening aqueous 42 to 55% by weight lye, preferably potash and soda lye, more preferably soda lye. The process according to the invention is characterized in that a compound corresponding to formula I is added with stirring to such a lye to form a paste-like composition to which one or more components from the classes of paraffin foam inhibitors and/or builders and/or paraffin oil and/or surfactants are added before solid alkali metal hydroxide, preferably potassium or sodium hydroxide, more preferably sodium hydroxide, or a mixture of these substances is added to achieve delayed, controlled and variable hardening of the detergent material. The process is carried out at temperatures of generally 20° C., to 50° C., preferably 30° C., to 48° C., and more preferably 38° C., to 42° C. Since the solubility of NaOH in water increases at relatively high temperatures, the NaOH content of the aqueous solution may even be more than 55% by weight. Conversely, the NaOH content may even be below 42% by weight at relatively low temperatures. Accordingly, the limitation to 42–55% by weight NaOH solutions is essentially confined to temperatures of 20° C., to 25° C.

One particular advantage of the present invention is that the stirrability of the detergent and the resulting advantages are guaranteed at temperatures as low as room temperature. In some cases, for example where the thickened lye, preferably potash and soda lye, more preferably soda lye, shows particularly high viscosity, it can be of advantage to increase the temperature slightly before the solid ingredients are added in order to reduce the viscosity. In almost every case, however, the consistency according to the invention can be achieved below 42° C., and preferably between 38° C., and 42° C., so that even heat-sensitive components, for example chlorine-containing bleaching agents, can be incorporated in the detergents according to the invention.

In one particular embodiment, premature hardening of the detergent as a result of the addition of solid alkali metal hydroxide is counteracted by adding other components, for example foam inhibitors, builders, paraffin oils and/or surfactants, beforehand. All or only certain substances from these classes may be added according to the required hardening time. A maximum hardening time is achieved by adding all the substances mentioned above in that order before solid alkali metal hydroxide is added for hardening. In one preferred embodiment, addition of the compound corresponding to formula I is followed by stirring for at least 3 minutes and preferably for 10 to 20 minutes before the addition of the other components which in turn is followed by stirring for at least 3 minutes and preferably 8 to 15 minutes.

Thus, the detergent may be produced, for example, in a stirred tank at 20 to 50° C., preferably at 30 to 48° C., and more preferably at 38 to 42° C. Through the addition of paraffin oils and/or surfactants in a specific sequence, the detergent has the process-related advantage that hardening of the detergent can be delayed to such an extent that no solid deposits accumulate in the production equipment used. The detergent may then be packed in marketing containers at around 40° C., and cooled to around 20° C., for example in a cooling tunnel, to achieve the consistency according to the invention. However, other methods may be used for packaging the detergents and cooling them to room temperature.

The solid detergents according to the invention may be used, for example, by spraying the detergent of controllable hardness accommodated in a container (holding capacity for example 0.5 to 10 kg) with water and using the detergent thus dissolved, for example by introducing it into a dishwashing machine, for example using dispensers of the type marketed by Henkel Hygiene GmbH under the name of Topmater® P40 or the VNT-2000 solids dispenser marketed by Henkel Ecolab. Paste-form dispensers may be directly introduced into the wash liquor from suitable dispensers designed to exert high pressures or may first be converted into a liquid with water and dispenser in that form.

EXAMPLES

1. Detergents with compositions 1 to 3 shown in Table 1 below were produced with differences in the addition sequence of the components and the composition of the detergents. 50% aqueous soda lyes were introduced into a 2 liter glass vessel and heated to 38–40° C. While methanol was slowly stirred in (60 r.p.m.), the temperature rose to around 46° C., after which stirring was continued for 15 minutes, paraffin was added as foam inhibitor and the whole was stirred for another 10 minutes. The temperature was then lowered to 38–40° C., and kept constant. The other components of the compositions optionally added were added in the order shown in the Table, followed by stirring for 10 minutes after each addition. After the last component (chlorine carrier) had been added, an expert measured the time the composition took to reach a degree of hardness that made stirring at 38 to 40° C., very difficult or even impossible. Purely phenomenologically, the composition then had a consistency in which it was unable as required to flow out through an outlet pipe in the bottom of a production vessel.

TABLE 1

Composition of detergents 1–3 (% by weight)

| Ingredient | 1 | 2 | 3 |
|---|---|---|---|
| Soda lye (50% aq.) | 75 | 50 | 40 |
| Methanol | 10 | 6 | 8 |
| Paraffin defoamer | 1.5 | 1.5 | 1.5 |
| NaOH (solid) (microprills) | — | 15 | 25 |
| Paraffin oil | — | 2 | 3.5 |
| Surfactant | 3.5 | 3.5 | — |
| Sodium triphosphate | 10 | 15 | 15 |
| Chlorine carrier (coated) | — | 7 | 7 |
| Consistency | Paste | Solid | Hard |
| Approx. max. stirring time (in minutes) | >60 | <60 | <10 |

2. Detergents 4 to 8 described in more detail in Table 2 below were produced as in Examples 1 to 3 using ethanol for alcoholate formation. In this case, the paraffin defoamer and the solid NaOH were introduced last.

TABLE 2

Composition of detergents 4–8 (% by weight)

| Ingredient | 4 | 5 | 6 | 7 | 8 |
|---|---|---|---|---|---|
| NaOH 50% | 51.5 | 39 | 39 | 44 | 47 |
| Ethanol | 7 | 6 | 6 | 6 | 6 |
| Sodium triphosphate | 30 | 26 | 26 | 26 | 26 |
| Glycerol | | | 1 | 3 | 3 |
| Soda | 10 | 6.8 | 5.8 | 3.8 | |
| Paraffin defoamer | 1.5 | 1.2 | 1.2 | 1.2 | |

TABLE 2-continued

| Composition of detergents 4–8 (% by weight) | | | | | |
|---|---|---|---|---|---|
| Ingredient | 4 | 5 | 6 | 7 | 8 |
| NaOH microprills | | 21 | 21 | 16 | 18 |
| Stirring time in mins. | >180 | <5 | 25 | 45 | >180 |

3. Detergents 9 to 13 described in more detail in Table 3 below were produced as in Examples 1 to 8 using methanol or butane-1,3-diol for alcoholate formation.

TABLE 3

| Composition of detergents 9–13 (% by weight) | | | | | |
|---|---|---|---|---|---|
| Ingredient | 9 | 10 | 11 | 12 | 13 |
| NaOH 50% | 85 | 85 | 51.5 | 51.5 | 76 |
| Butane-1,3-diol | 10 | 10 | | 12 | |
| Methanol | | | 12 | | 18 |
| NaOH microprills | 5 | | | | |
| Sodium nitrilotriacetate | | 5 | 25 | 25 | |
| Soda | | | 10 | 10 | |
| Paraffin defoamer | | | 1.5 | 1.5 | |
| Surfactant | | | | | 6 |
| Consistency | Paste | Paste | Paste | Solid | Paste |

4. Detergents 14 to 20 described in more detail in Table 4 below were produced in the same way as in the preceding Examples. The chlorine carrier and then the solid NaOH were incorporated as the last components.

TABLE 4

| Composition of detergents 14 to 20 (% by weight) | | | | | | | |
|---|---|---|---|---|---|---|---|
| | 14 | 15 | 16 | 17 | 18 | 19 | 20 |
| Soda lye (50%) | 50.00 | 50.00 | 43.00 | 50.00 | 40.00 | 50.00 | 44.00 |
| Glycerol | 3.00 | 3.00 | 3.00 | 4.00 | 3.00 | 3.00 | 3.00 |
| Sodium triphosphate | 14.50 | 14.50 | | | 23.00 | 14.50 | 10.00 |
| Sodium nitrilotriacetate | | | 30.00 | | | | |
| Sodium methylenediamine tetraacetate | | | | 26.00 | 14.00 | | |
| Nonionic surfactant Plurafac LF 403 (BASF) | | | 1.50 | 1.00 | 3.00 | | 2.50 |
| $Na_2CO_3$ | 8.50 | 8.50 | 9.50 | | | 9.00 | 2.50 |
| $Na_2SO_4$ | | | | 7.00 | | | |
| NaCl | 6.50 | 3.50 | | | | | |
| Sodium metasilicate | 0.50 | 0.50 | | | | 0.50 | |
| Sodium dichloroisocyanurate | | 3.00 | | | | 6.00 | |
| NaOH solid (microprills) | 17.00 | 17.00 | 13.00 | 12.00 | 17.00 | 17.00 | 38.00 |

What is claimed is:

1. A paste-form to solid detergent composition comprising:

a) 21 to 70 percent by weight of an aqueous lye solution having a concentration of 42 to 55 percent by weight of lye;

b) 0.5 to 40 percent by weight of one or more alcoholates of ethanol, propanol, isopropanol, or glycerol, and c) 10 to 35 percent by weight of water.

2. The composition of claim 1 comprising 35 to 55 percent by weight of said aqueous lye solution.

3. the composition of claim 1 wherein said aqueous lye solution comprises potash or soda lye.

4. The composition of claim 1 wherein said alcoholates comprise potassium or sodium alcoholates.

5. The composition of claim 1 comprising 1 to 10 percent by weight of said alcoholates.

6. The composition of claim 5 comprising 2 to 8 percent by weight of said alcoholates.

7. The composition of claim 1 further comprising substances selected from the group consisting of alcohols corresponding to said alcoholates, foam inhibitors, builder components, paraffin oil, surfactants, alkali metal hydroxide in solid form, and mixtures thereof.

8. The composition of claim 7 comprising up to 35 percent by weight of said solid alkali metal hydroxide.

9. The composition of claim 8 comprising 2 to 25 percent by weight of said solid alkali metal hydroxide.

10. The composition of claim 7 comprising up to 30 percent by weight of said surfactants.

11. The composition of claim 10 comprising 0.1 to 15 percent by weight of said surfactants.

12. The composition of claim 11 comprising 1 to 10 percent by weight of said surfactants.

13. The composition of claim 12 comprising 2 to 4 percent by weight of said surfactants.

14. The composition of claim 7 wherein said surfactants are selected from the group consisting of nonionic surfactants, alkyl benzenesulfonates, fatty alcohol sulfates, fatty alcohol ether sulfates, and mixtures thereof.

15. The composition of claim 7 comprising up to 10 percent by weight of said paraffin oil.

16. The composition of claim 15 comprising 0.1 to 8 percent by weight of said paraffin oil.

17. The composition of claim 16 comprising 0.5 to 5 percent by weight of said paraffin oil.

18. The composition of claim 7 comprising up to 60 percent by weight of said builder.

19. The composition of claim 18 comprising 15 to 40 percent by weight of said builder.

20. The composition of claim 18 wherein said builder is selected from the group consisting of pentasodium triphosphate, trisodium citrate, nitrilotriacetate, ethylenediamine tetraacetate, sodium salts of polyacrylic acid of maleic acid/acrylic acid copolymers, soda, alkali metal silicate, and mixtures thereof.

21. The composition of claim 1 comprising 20 to 30 percent by weight of water.

22. A process for the production of the detergents of claim 1 comprising adding 0.5 to 40 percent by weight, based on the detergent, of alcoholates of ethanol, propanol, isopropanol, or glycerol, to 21 to 70 percent by weight of an aqueous lye solution having a concentration of 42 to 55 percent by weight of lye.

23. The process of claim 22 further comprising adding one or more of the following substances to the aqueous lye solution in the order listed: alcohols corresponding to said alchoholates, foam inhibitors, builder components, paraffin oil, and surfactants, followed by the addition, with stirring, of 0.1 to 35 percent by weight of alkali metal hydroxide in solid form to the resulting aqueous lye solution.

24. The process of claim 23 comprising adding 2 to 25 percent by weight, based on the detergent as a whole, of solid alkali metal hydroxide.

25. The process of claim 22 comprising stirring for at least three minutes the solution comprising said alcoholates and aqueous lye solution following the addition of said alcoholates.

26. The process of claim 25 wherein said stirring is for 10 to 20 minutes.

27. The process of claim 22 comprising stirring the resultant solution for at least 3 minutes following each further addition of a substance.

28. The process of claim 27 wherein said stirring is for 8 to 15 minutes.

29. The process of claim 22 wherein said addition occurs at from 20 to 50° C.

30. The process of claim 29 wherein said addition occurs at from 30 to 48° C.

31. The process of claim 30 wherein said addition occurs at from 38 to 42° C.

32. A process for cleaning tableware comprising dissolving said composition of claim 1 in water, and contacting said solution with tableware.

33. A process for washing laundry comprising dissolving said composition of claim 1 in water, and contacting said solution with laundry.

* * * * *